United States Patent [19]

Joshua

[11] Patent Number: 4,648,116

[45] Date of Patent: Mar. 3, 1987

[54] · SOUND PANNING APPARATUS

[76] Inventor: Ayal Joshua, 12978 SW. 88 Lane, Miami, Fla. 33186

[21] Appl. No.: 659,298

[22] Filed: Oct. 10, 1984

[51] Int. Cl.[4] ..... H04R 5/00

[52] U.S. Cl. ..... 381/18; 381/24; 381/62

[58] Field of Search ..... 381/62, 24, 63, 64, 381/17, 18; 340/722; 84/DIG. 4, DIG. 26, 1.24

[56] References Cited

U.S. PATENT DOCUMENTS 4,017,796 4/1977 Tobias ..... 340/722

4,039,956 8/1977 Shimanek et al. ..... 340/722

FOREIGN PATENT DOCUMENTS 1549292 7/1979 United Kingdom .

OTHER PUBLICATIONS

Chowning, "The Simulation of Moving Sound Sources", Computer Music Journal, Jun. 1977.

A Professional Search of the PTO Files did not Find any Relevant Art, i.e. Computer-Controlled Panning Devices.

*Primary Examiner*—Forester W. Isen

*Attorney, Agent, or Firm*—Victor F. Volk

[57] ABSTRACT

Sound projecting apparatus employs a microcomputer to pan a musical performance automatically, according to a preset program, and to display the instantaneous location of the apparent sound source by means of an array of lights.

4 Claims, 7 Drawing Figures

SOUND PANNING APPARATUS

BACKGROUND OF THE INVENTION

In the projection of a musical performance, either live or from a tape, certain types of music require the sound engineer to add a panning effect whereby two loud speakers, or groups of loud speakers, which may be regarded as left (L) and right (R) are alternately preferentially energized so that the sound appears to cycle back and forth between them. Presently available equipment does not provide an effective control of this panning. Typically, control of an acoustic image from L-R is provided by manual operation of a panoramic potentiometer (pan-pot). In movement of specific signals along the L-R plane, which may be visualized as having a vertical dimension comprised of a plurality of tracks or sound sources, time must be alloted during mixdown sessions to let the engineer manipulate the image to the desired position. Control and accuracy of panning are, therefore, limited, and wasteful of the sound engineer's time and attention.

SUMMARY OF THE INVENTION

I have invented an apparatus for projecting a sequence of sounds comprising a means for energizing each of a pair of loudspeaker means, and means for automatically, alternately and repeatedly reducing the energy to one of said pair while increasing the energy to the other of said pair in cycles as established by a preset program. Preferably, my apparatus comprises a microcomputer for recording and storing the program and establishing the minimum and maximum energy of each of the cycles (which translates into the apparent horizontal start and stop of the sound image panning effect), the number of cycles repeated for any effect, and the cycle frequency.

Preferably, also, my apparatus comprises at least one voltage-controlled amplifier, manual reset means for repeating the program or portions of it, and, usually, more than one, such as four, of the energizing means and means for recording and storing a program for each. I have invented an apparatus for panning a sequence of sounds, and visual display means such, preferably, as an array of light emitting diodes and microcomputer means for controlling them, for instantaneously exhibiting the apparent location of the sound source in accoustical L-R space.

DETAILED DESCRIPTION OF A PREFERRED EMBODIMENT

I have shown herein my apparatus that provides automatic panning control to four tracks, and is expandable to eight tracks with minimal change. Each track (or channel) has one input, as from a single microphone, and two outputs, L and R and may be viewed as a black box replacing an actual console pan-pot. In my automatic pan-pot the signal passes through a VCA which is the energizing means for a pair of loudspeaker means. The VCA splits the signal between L and R loudspeaker means. The rest of the hardware and software provides the control voltage to the VCA.

Figure 1A:
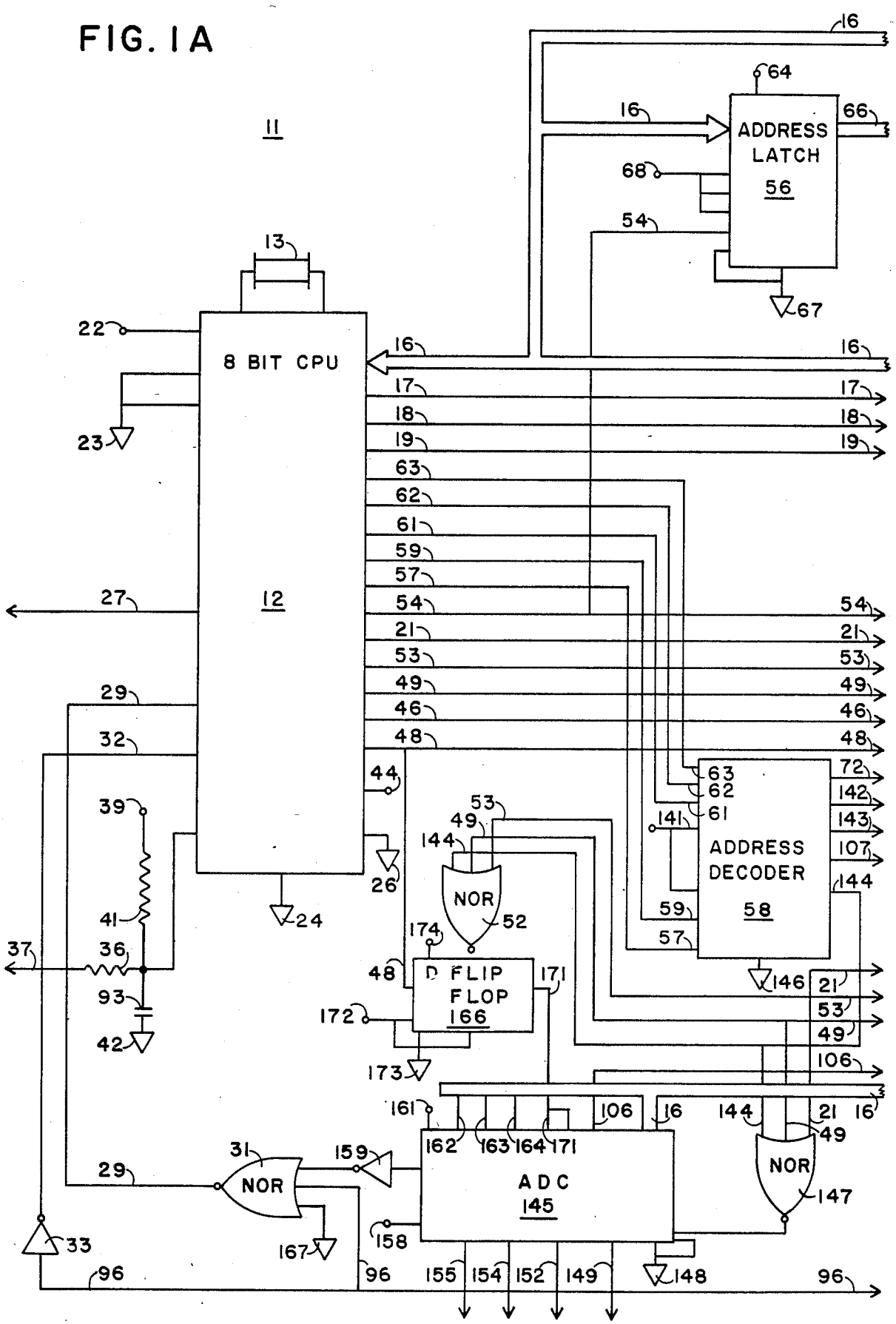
FIGS. 1A and 1B show a wiring diagram of the processor board of my apparatus.
Figure 1B:
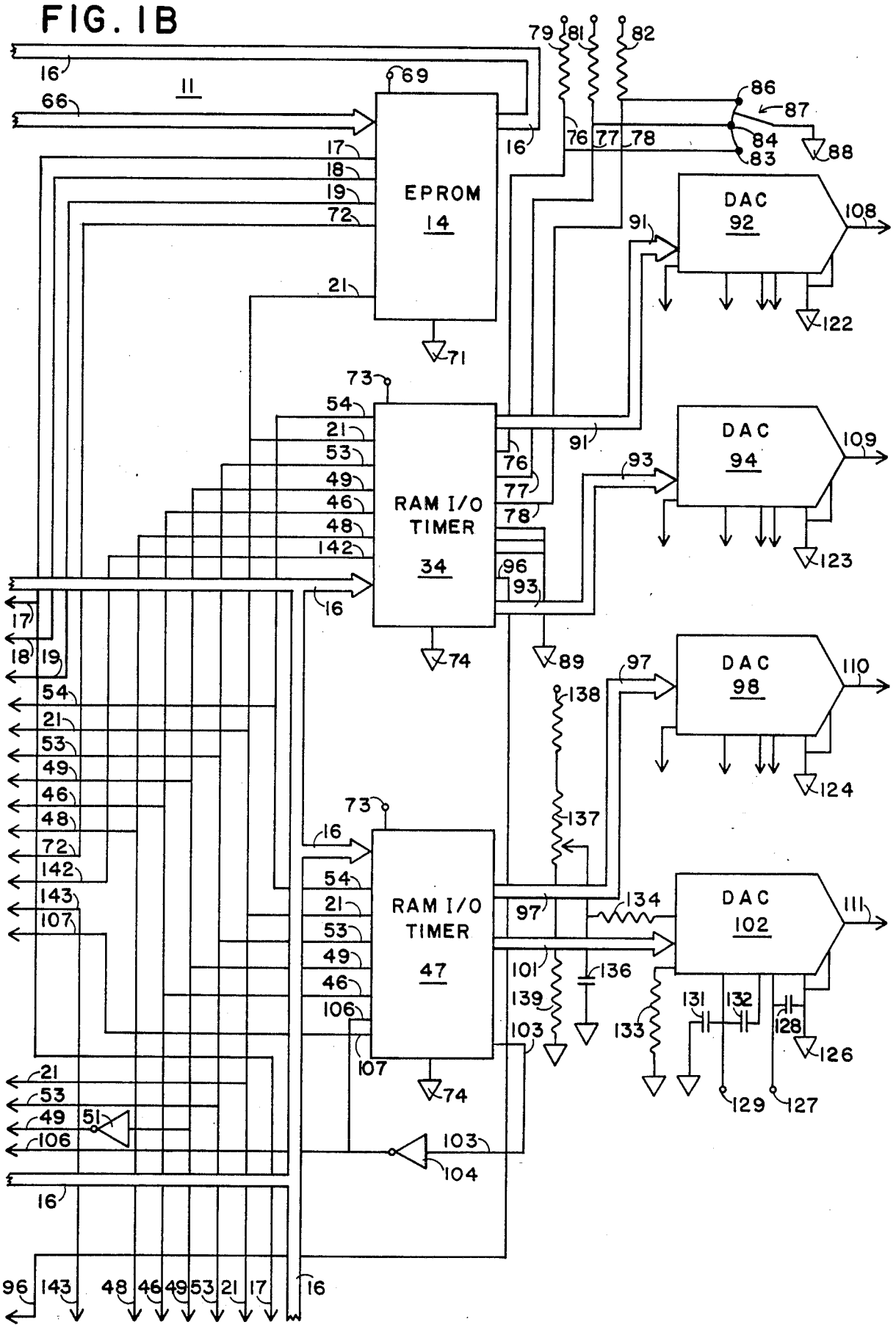

The system comprise three modules, each housed on one of the separate boards diagrammed in FIGS. 1A, 1B; 2A, 2B; 3A, 3B; and 4. Refer first to FIGS. 1A, 1B which depict a process board 11. The board 11 comprises a plurality of integrated chips and their connecting wiring. A central processing unit (CPU) 12 with a crystal 13 for generating a clock frequency of 6.144 megahertz is mounted on the board 11. I have used an 8085 CPU system that is commercially available from the Intel Corporation of Santa Clara, Calif. whose widely distributed publications: Intel MCS-80/85 User's Manual, Intel Micro-Processor/Peripheral Handbook, and Intel SDK-85 User's Manual have contents included herein by reference. The contents of the National Semiconductor Data Acquisition Handbook and the Active Filter Cookbook are also included herein by reference as is a Univac 1100 Time Sharing Exec computer printout, submitted herewith defining software to be discribed. The remainder of my circuitry has been selected to be compatible with the 8085 CPU system, but other chips such as the 8080, 8086, 8051 from Intel; the 6502 and 6800 from Motorola, the Z-80 from Zilog, the CDP 1802 from RCA, and the TMS 1000 NL from Texas Instruments might be equivalently employed by persons skilled in microcomputer arts to implement the novel conception herein disclosed. Each of these other chips would require modification of the other elements of my preferred apparatus. The software for the chip 12 is disclosed in the above-mentioned Univac printout which is identified as LEV. 38R5AVI-29.

Figure 2A:
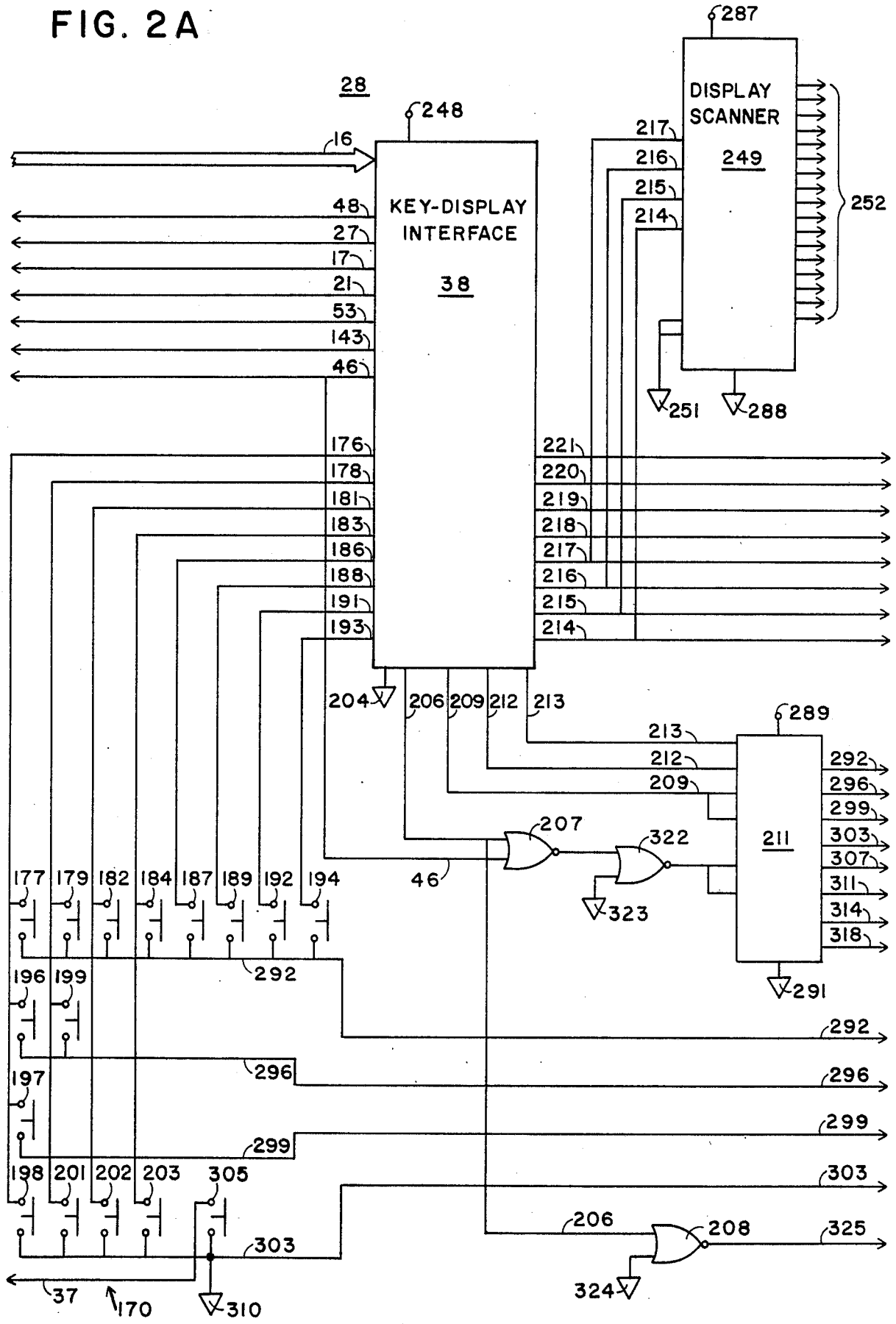
FIGS. 2A and 2B show a wiring diagram for the key and display board of my apparatus.

An Intel 2716 chip 14 comprising an operating system memory EPROM 2K×8 has pins numbered "9"-"11", —13"-"17" connected by a bus 16 to pins numbered "12"-"19" of the chip 12. Through the lines or leads 17, 18, 19, 21 to pins numbered "23", "22", "19", "20" respectively of the chip 14, the respective pins numbered "21", "22", "23", "32" of the chip 12 are also connected. The pin numbered "40" of the chip 12 is connected to a 5-volt source 22, and the pins numbered "6" and "10" are connected to a ground 23. (Note that I have assigned different numerals to the ground positions and 5-volt sources for the sake of clarity in reading the drawing although a single ground and 5-volt source is common to the circuits on each board.) Other grounds 24, 26 are respectively connected to pins numbered "20" and "39" of the chip 12. A lead 27 from the pin "9" of the chip 12 connects to a board 28 housing the display circuitry, and a lead 29 from the pin numbered "8" of the chip 12 connects to the pin numbered "8" of a chip 31 which is ⅓ of an NS (National Semiconductor) 7427 constituting a NOR gate. The pin numbered "7" of the chip 12 connects by means of a lead 32 to the pin numbered "8" of an inverter 33 which constitutes 1/6 of an NS 7404, the pin numbered "9" of which connects, through lead 96, to the pin numbered "11" of the chip 31 and the pin numbered "6" of an 8155 RAM-/IO/timer chip 34 to be further described. The pin numbered "36" of the chip 12 connects through a 1000-ohm resistor 36 and lead 37 to a key switch 305 labelled "reset" on the board 28 (FIG. 2A). The lead 37 is connected to a 5-volt source 39 through a 51000 ohm resistor 41, and to a ground 42 through a 1 μf condenser 43. The "ready" pin numbered "35" of the chip 12 is also connected to a 5-volt source 44 and the pin numbered "3" of the chip 12 connects through a lead 46 to the pin numbered "4" of the chip 34 and the pin numbered "4" of the chip 47 to be described, and also to the pin numbered "9" of the chip 38 and the pin numbered "3" of the chip 207 (FIG. 2A). A lead 48 from the pin numbered "37" of the chip 12 connects with the pin numbered "3" of the RAM/I-O/timer chip 34 and to the pin numbered "3" of the chip 38 (FIG. 2A) and a pin numbered "34" if the chip 12 connects, by means of a lead 49 to the pin numbered "7" of the chip 34, the pin numbered "7" of the chip 47, and the pin numbered "3" of 1/6 of an NS 7404 inverter gate chip 51, thence, from the pin numbered "4" of this chip, to a pin numbered "4" of 1/6 of an NS 7427 NOR gate chip 52.

Continuing with the Intel 8085 chip 12, the pin numbered "31" connects, by means of a lead 53 to the pins numbered "10" of the chips 34 and 47, the pin numbered "5" of the chip 52 and the pin numbered "11" of the chip 38 (FIG. 2A). A lead 54 connects the pin numbered "30" to the pin numbered "13" of an Intel 8212 address latch chip 56, and to the pins numbered "11" of the chips 34 and 47. A pin numbered "28" of the chip 12 is connected by means of a lead 57 to a pin numbered "4" of an Intel 8205 address decoder chip 58. The pin numbered "27" of the chip 12 connects, by means of a lead 59, to the pin numbered "5" of the chip 58 and a lead 61 connects the pin numbered 26 of the chip 12 to a pin numbered "3" of the chip 58. A lead 62 connects the pin numbered "25" of the chip 12 to the pin numbered "2" of the chip 58, and a lead 63 connects the pin numbered "24" of the chip 12 to the pin numbered "1" of the chip 58. The bus 16 connects the pins numbered "12" to "19" of the chip 12 to pins numbered "3", "5", "7", "9", "16", "18", "20", "22" of the chip 56, pins numbered "9" to "11" and "13" to "17" of the chip 14, pins numbered "12" to "19" of the chips 34, 47 and 38 (FIG. 2A), and pins numbered "18" to "21", "17", "14", "8", "15", "25", "24", "23" of an NS ADC 0800 chip 145. The pins' numbers quoted hereinabove and to follow are not shown in the drawing for the sake of clarity, but there enumeration here will enable anyone skilled in these arts to wire up my innovative structure, since the numbers appear to the commercially available chips herein named. The chip 56 serves as an address latch for demultiplexing the address from the address/data lines of the chip 14.

On the chip 56 a pin numbered "24" is connected to a 5-volt source 64, and a bus 66 connects the pins numbered "4", "6", "8", "10", "15", "17", "19", "21" to the pins numbered "8" to "1" of the chip 14; the pins numbered "1" and "12" are connected to a ground 67, and the pins numbered "14", "2", "11" are connected to a 5-volt source 68. To the already mentioned connections of the chip 14 should be added one from the pin numbered "24" to a 5-volt source 69, and one from the pin numbered "12" to a ground 71. A lead 72 connects the pin numbered "18" of the chip 14 to a pin numbered "15" of the chip 58. The two chips 34 and 47 have had their leads 54, 21, 53, 49, 46, and 48 described hereinabove. In addition, each of these RAM/I-O/timer chips has a 5-volt lead 73 to its pin numbered "40" and grounds 74—74 wired to its pin numbered "20". Pins numbered "37", "38", "39" of the chip 34 are respectively connected by leads 76, 77, 78 through 2200 ohm resistors 79, 81, 82 to 5-volt sources. A manual contact 83, auto contact 84 and program contact 86 of a manual 3-way mode switch 87 are tapped to the respective leads 76, 77, 78 for grounding at a ground 88. The switch 87, for which I prefer a slide switch, selects a 6-bit word for the chip 34 I/O port where each word corresponds to each of the three operating systems routines. Upon reset the chip 12 starts at address zero. The first few instructions load the word from the I/O port to the CPU chip 12 and branch to the routing corresponding to the selected word.

Pins numbered "1", "2", "5" of the chip 34 are connected to a ground 89, and pins numbered "21"–"28" are connected through a bus 91 to the pins numbered "5"–"12" of an NS DAC 0800 chip 92, while pins numbered "29"–"36" are connected through a bus 93 to the pins numbered "5"–"12" of an NS DAC 0800 chip 94. The pin numbered "6" of the chip 34 is connected by a lead 96 to the pin numbered "9" of invertor gate 1/6 7404 33 and to the pin numbered "11" of the chip 31. Pins numbered "21"–"28" of the chip 47 are connected by a bus 97 to pins numbered "5"–"12" of an NS DAC 0800 chip 98, and pins numbered "29"–"36" are connected by a bus 101 to pins numbered "5"–"12" of a DAC 0800 chip 102. The pin numbered "6" of the chip 47 is connected by a lead 103 to the pin numbered "1" of 1/6 of a 7404 gate chip 104, and thence from the pin numbered "2" of the chip 104 a lead 106 connects to the pin numbered "3" of the chip 47 and the pin numbered "10+ of the chip 145. The pin numbered "8" of the chip 47 is connected by a lead 107 to the pin numbered "12" of the chip 58.

Figure 3A:
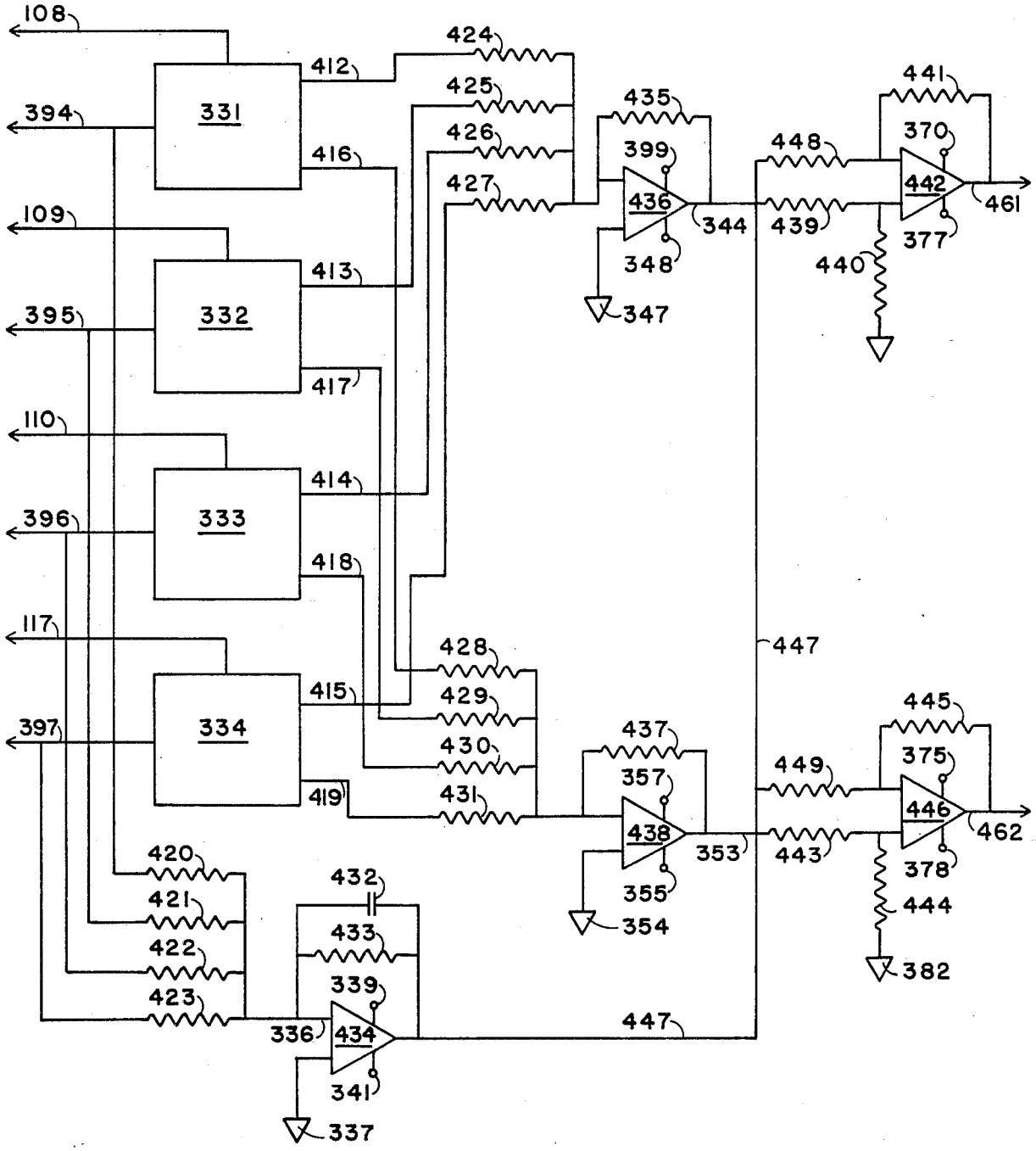
FIG. 3A shows a wiring diagram of the VCA and interface board of my apparatus.

From its pin numbered "4" each of the four chips 92, 94, 98, 102 has one of the respective leads 108, 109, 110, 111 to the "boxes" of FIG. 3A, as shall be described. Pins numbered "1" and "2" of the chips 92, 94, 98, 102 are connected respectively to grounds 122, 123, 124, 126, and a pin numbered "13" of the chip 102 is connected to a −15 volt source 127, and through a 0.01 μf capacitor 128 to the ground 126. The pin numbered "3" of the chip 102 is connected to a 15-volt source 129 and, through a 0.1 μf capacitor 131, to ground as pins numbered "3" and "16" are connected through a 0.01 μf capacitor 132. The pin numbered "15" is grounded through a 4700 ohm resistor 133 and the pin numbered "14" is connected through a 5600-ohm resistor 154 and a 0.01 μf capacitor 136 to ground and to a variable resistance 137 which connects through a 350-ohm resistor 138 to a 15-volt source, and through a 1000-ohm resistor 139, to ground. Chips 92, 94, 98, 102 have identical connections. All of the connections on the chip 102 may be superimposed onto chips 92, 94, 98, except for the pins "5"–"12" and "4" which connect as described above.

The pins numbered "6" and "16" of the address decoder chip 58 are connected to a 5-volt source 141, the pin numbered "14" is connected by a lead 142 to the pin numbered "8" of the chip 34, the pin numbered "13" is connected to the pin numbered "22" of the chip 38 (FIG. 2A) by a lead 143, and a lead 144 connects the pin numbered "11" to a pin numbered "3" of the chip 52. The pin numbered "8" is connected to a ground 146.

Figure 4:
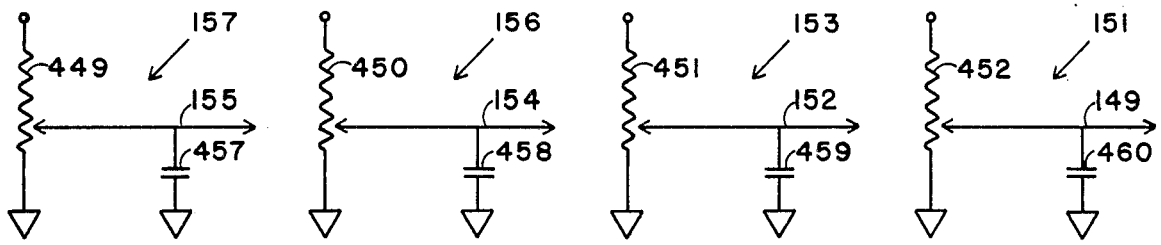
FIG. 4 shows the circuitry of the pan-pots that may be used in my invention.

An ADC chip 145 is an NSADC 0808 8-channel multiplexed A/D. Its pins numbered "18"–"21" and "17", "14", "8", "13" connect to the bus 16. On this chip 145 the pin numbered "9" is connected to a pin numbered "12" of the chip 147 which is ⅓ of a 7427 NOR gate. The pin numbered "13" of the chip 147 connects to the lead 144. Its pin numbered "2" connects to the lead 49 and its pin numbered "1" connects to the lead 21. Pins numbered "13" and "16" of the chip 145 are grounded at 148, the lead 152 from the pin numbered "28" is connected to a pan-pot 153, the lead 154 from the pin numbered "27" of the chip 145 is connected to a pan-pot 156, a lead 149 from the pin numbered "1" of the chip 145 is connected to a pan-pot 151, and a lead 155 from the pin numbered "26" of the chip 145 is connected to a pan-pot 157 (FIG. 4). The pin numbered "12" of the chip 145 is connected to a 5-volt source 158 and the pin numbered "7" of the chip 145 connects to a pin numbered "11" of an inverter gate 1/6 7404 chip 159, The pin numbered "11" of the chip 145 is connected to a 5-volt source 161, the pin numbered "25" of the chip 145 is connected to its pin numbered "18" by means of a lead 162, and the pin numbered "24" connects to its pin numbered "19" by means of a lead 163, and the pin numbered "23" connects to its pin numbered "20" by means of a lead 164. The pin numbered "12" of the chip 147 is connected to the pin numbered "9" of the chip 145, the pin numbered "1" of the chip 147 connects by means of the lead 21 to the chips 12, 14, 47, 34 are hereinabove noted, but also to the pin numbered "10" of the chip 38 (FIG. 2A). The chip 52 connects not only to all those chips that connect to the leads 49, 53, and 144, as has been described but has its pin numbered "6" connected to the pin numbered "1" of a 7474 D flip-flop chip 166. The remaining chip 31 which has been stated to connect to the chips 12 and 34 also has its pin numbered "10" connected to the pin numbered "10" of the chip 159 and its pin numbered "9" grounded at 167.

The chip 166, besides being connected to the chip 52, as above noted, has its pin numbered "5" connected to the pins numbered "6" and "22" of the chip 145 by means of a lead 171, and its pins numbered "4" and "2" connected to a 5-volt source 172, its pin numbered "7" grounded at 173, its pin numbered "3" connected to the lead 48, and, finally, its pin numbered 14 connected to a 5-volt source 174.

On the key display board 28 the key display interface chip 38 has had its connections with the processor board 11 described above. It is further connected on the board 28 from its pin numbered "38" and a lead 176 to manual switch buttons 177, labelled "0", 196 labelled "8", 197 labelled "CH" and 198 labelled "RA" of a key pad 170. From its pin numbered "37" and a lead 178 the chip 38 is connected to manual switch buttons 179 labelled "1", 199 labelled "9" and and 201 labelled "ST". From the chip 38 the pin numbered "1" and lead 181 connection is made to manual switch buttons 182 labelled "2", and 202 labelled "SP"; from a pin numbered "2" and a lead 183 to buttons 184 labelled "3" and 203 labelled "CY". From a pin numbered "5" of the chip 38 a lead 186 connects to a button 187 labelled "4", from the pin numbered "6" through the lead 188 to a button 189 labelled "5", from the pin numbered "7" of the chip 38 through the lead 191 to a button 192 labelled "6" and from the pin numbered "8' of the chip 38 and a lead 193 to a manual switch button 194 labelled "7".

The pin numbered 20 of the chip 38 is grounded at 204, the pin numbered "35" connects by means of a lead 206 to a pin numbered "2" of a ¼ 7402 NOR gate chip 207 and pin numbered "8" of a ¼ 7402 chip 208. The pin numbered "34" of the chip 38 is connected by a lead 209 to pins numbered "1" and "15" of a 74156 3→8 decoder chip 211 which serves as a display scan controller in this configuration. The pin numbered "33" of the chip 38 connects by a lead 212 to the pin numbered "3" of the chip 211 and the pin numbered "32" of the chip 38 connects by means of a lead 213 to a pin numbered "13" of the chip 211. Eight pins on the chip 38 numbered "28", "29", "30", "31", "24", "25", "26", "27" are connected through respective leads 214, 215, 216, 217, 218, 219, 220, 221 through respective 3000-ohm resistors 222, 223, 224, 225, 226, 227, 228, 229 to the bases respectively of transistors 231, 232, 233, 234, 235, 236, 237, 238 whose emitters are all connected to 5-volt sources and whose collectors are respectively connected through eight 32-ohm resistors 230 to respective light emitting diodes 239, 240, 241, 242, 243, 244, 245, 246 of a seven-segment display panel 247 and to four other 7-segment displays, not shown, of thich the panel 247 is representative. The pin numbered "40" of the chip 38 connects to a 5-volt source 248.

The leads 214, 215, 216, 217 connect respectively to the pins numbered "20", "21", "22", "23", of an NS 75154 9→16 decoder chip 249 which serves as a display scan decoder in this configuration, and whose pins numbered "18", "19" are grounded at 251. Pins numbered "1"–"11", "13"–"17" on the chip 249 are individually connected by sixteen leads 252 through an equal number of 3000-ohm resistors 253 to the bases of transistors 254–269 and thence, from the collectors of these transistors through the sixteen 32-ohm resistors 270 to the light emitting diodes 271–276. I have three other panels (not shown) wired in the same manner. The emitters of the transistors 254–269 are each connected to a 5-volt source, as is the pin numbered "24" of the chip 249, to the source 287. The pin numbered 12 of the chip 249 is grounded at 288. The chip 211 whose connection to the chip 38 has been described has a pin numbered "16" connected to a 5-volt source 289 and a pin numbered "8" connected to a ground 291. The pin numbered "9" of the chip 211 is connected through a lead 292 through a 270-ohm resistor 293 to the base of a transistor 294 that has its collector grounded and its emitter connected to the LED's 239–246. The lead 292 also connects to the push-button 177, 179, 182, 184, 187, 189, 192, and 194, as shown, while the lead 296 is connected to the push-buttons 196 and 199. A pin "10" of the chip 211 is connected via a lead 296 through a 270-ohm resistor 297 to the base of a transistor 298 whose collector is grounded and whose emitter is connected to the common cathode output of the 2nd 7-segment display (not shown). The pin numbered "11" of the chip 211 is connected by a lead 299 through a 270-ohm resistor 301 to the base of a transistor 302 whose collector is grounded and whose emitter is connected to the common cathode output of the 3rd 7-segment display (not shown). The lead 299 also connects to the push-button 197. The pin numbered "12" of the chip 211 is connected through a lead 303, through a 270-ohm resistor 304 to the base of a transistor 306 whose collector is grounded and whose emitter is connected to the common cathode output of the fourth 7-segment display (not shown). The lead 303 also connects to the push-buttons 198, 201, 202, 203, 305, and a ground at 310. The push-button 305 resets my apparatus and is connected through the lead 37 and 1000-ohm resistor 36 to the chip 12, as hereinbefore described. The pin numbered "7" of the chip 211 connects through a lead 307 through a 270-ohm resistor 308 to the base of a transistor 309 whose collector is grounded and whose emitter is connected to the common cathode of the fifth 7-segment display (not shown). The pin numbered "6" of the chip 211 is connected by means of a lead 311, through a 270-ohm resistor 312 to the base of a transistor 313 whose emitter is connected to an array of LED's 271–286. The pin numbered "5" of the chip 211 is connected through a lead 314, through a 270-ohm resistor 316 to the base of a transistor 317 whose collector is grounded and whose emitter is connected to the common cathode of the second 16-segment LED BAR display (not shown). The pin numbered "4" of the chip 211 is connected by means of a lead 318 through a 270-ohm resistor 319 to the base of a transistor 321 whose collector is grounded and whose emitter is connected to the common cathode of the third 16-segment LED BAR display (not shown). The pins numbered "2" and "14" of the chip 211 connect to the pin numbered "4" of ¼ of a 7402 logic gate chip 322 whose pin numbered "6" is grounded at 323 and whose pin numbered "3" has been described as connecting to the chip 207.

The pin numbered "9" of the aforementioned chip 208 is grounded at 324 and the pin numbered "10" of this chip is connected by a lead 325, through a 220-ohm resistor 326 to the base of a transistor 327 whose collector is grounded and whose emitter is connected to the common cathode of the fourth 16-segment LED BAR display (not shown). The transistors 294, 298, 302, 306, 309, 313, 317, 321, 327, and 254–269 are preferably 2N2907 although transistors of similar function are known and can be used within the scope of my invention.

Referring now to FIG. 3A which describes a VCA-/Interface board 300, four "boxes" 331, 332, 333, 334 that represent circuits which include VCA's are shown. A circuit 335 of the "box" 331 is detailed in FIG. 3B, and the circuits of the "boxes" 332, 333, and 334 are identical except for the entering leads. The "box" 331 is connected by the leads 108, 394 and also by leads 412 and 416. The "box" 332 is connected in the same manner by the leads 109 and 395, and also by leads 413 and 417; the "box" 333 is similarly connected by the leads 110 and 396; and also by leads 414 and 418; and the ∓box" 334 is correspondingly connected by the leads 111 and 397, and also by leads 415 and 419. The leads 394, 395, 396, and 397 connect, through respective 10000-ohm resistors 420, 421, 422, 423 and a lead 336 to the pin numbered ∓2" of a signetics NE 5534 op-amp chip 434. A 130 μf capacitor 432 and 10000-ohm resistor 433 connect in parallel between the lead 336 to the pin numbered "2" and a lead 447 to the pin numbered "6" of the chip 434. The pin numbered "3" of the chip 434 is connected to a ground 337, and the pin numbered "7" of this chip is connected to a 15-volt source 339, while the pin numbered "4" connects to a −15-volt source 341. The leads 412, 413, 414 and 415 connect through respective 10000-ohm resistors 424, 425, 426, 427, and a lead 343, to the pin numbered "2" of a chip 436, identical to the chip 434. A 10000-ohm resistor 435 connects between the lead 343 and a lead 344 from the pin numbered "6" of the chip 436. The pin numbered "3" of the chip 436 is grounded at 347 and the pins numbered "4" and "7" are respectively connected to −15-volt source 348 and 15-volt source 349. Leads 416, 417, 418, and 419 connect, through respective 10000-ohm resistors 428, 429, 430, 431, and a lead 351, to the pin numbered "2" of a chip 438, identical to the chips 434 and 436. A 10000-ohm resistor 437 connects the lead 351 to a lead 352 that is connected to the pin numbered "6" of the chip 438. The pin numbered "3" of this chip is grounded at 354, while the pins numbered "4" and "7" are respectively connected to −15-volt source 355 and 15-volt source 357. The lead 447 from the pin numbered "6" of the chip 434 connects through 10000-ohm resistors 448 and 449 to pins numbered "2" of chips 442 and 446 respectively, which are National Semiconductor LM 318 op-amps.

Resistors 441 and 445 of 10000-ohms each connect the lead 447 to respective leads 461 and 462 which connect to the pins numbered "6" of the respective chips 442 and 446. The lead 461 carries the summed left output and the lead 462 carries the summed right output. The pin numbered "7" of the chips 442 and 446 are connected respectively to 15-volt sources 370 and 375, and the pins numbered "4" of the chip 442 and 446 are connected respectively to −15-volt sources 377 and 378. The lead 344 connects, through a 2200-ohm resistor 439, to the pin numbered "3" of chip 442, and also through a 2200-ohm resistor 440, to a ground 381. Similarly, the lead 353 connects, through a 2200-ohm resistor 443, to the pin numbered "3" of the VCA chip 446, and also, through a 2200-ohm resistor 444, to a ground 382.

Figure 3B:
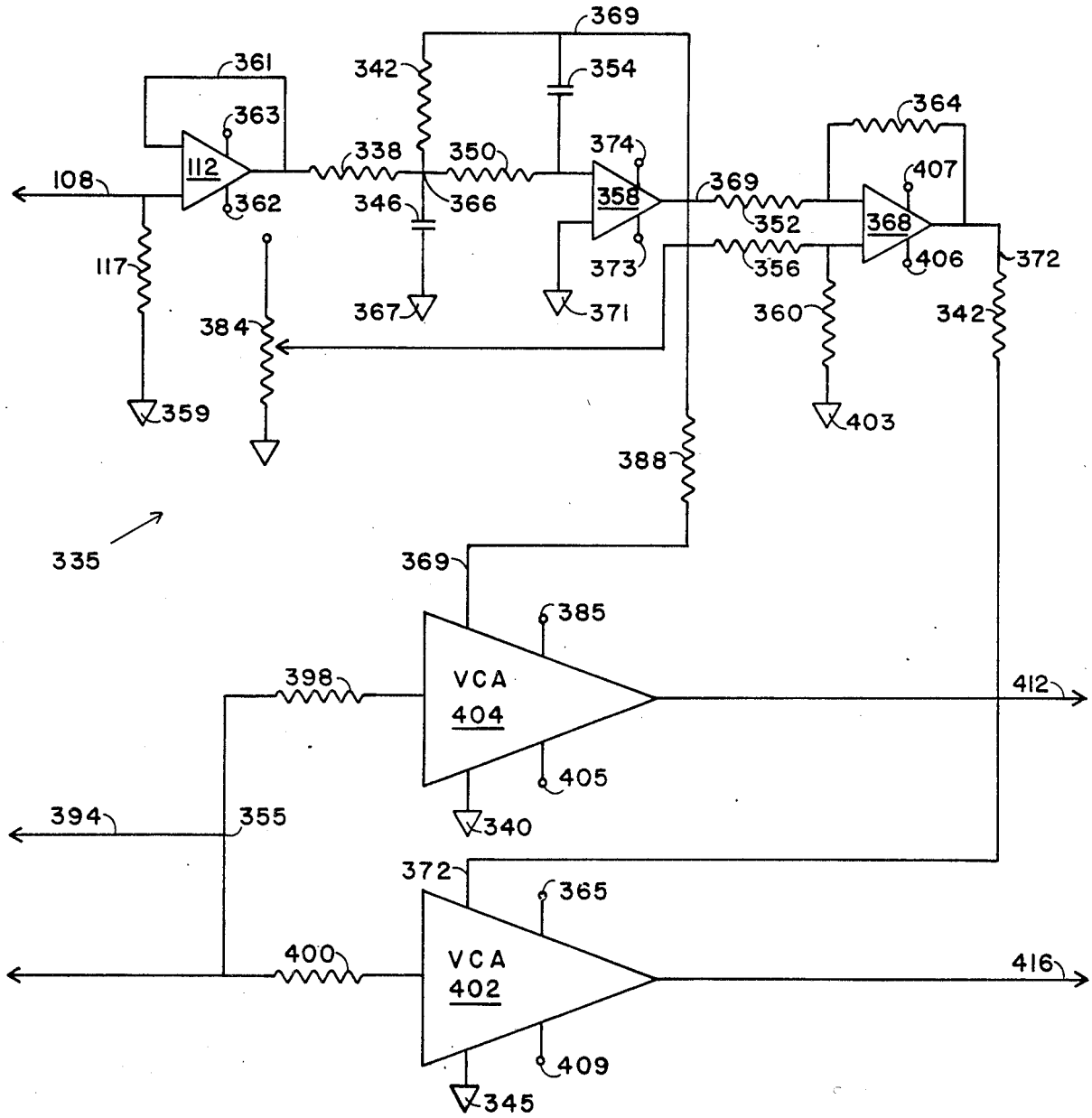
FIG. 3B shows the circuitry common to each of the "boxes" of FIG. 3A.

FIG. 3B shows the circuitry of the "box" 331 and, except for the four leads mentioned above, the contents also of the "boxes" 332, 333 and 334. Lead 108 provides the analog signal representing the control voltage information from the DAC's located on the processor board 11. Lead 108 connects to the pin numbered "3" of an NS* LM741 op-amp chip 112 and to a ground 359 through a 1000-ohm resistor 117. Pins numbered "2" and "6" of the chip 112 are shorted together by a lead 361, and pins numbered "4" and "7" are respectively connected to −15-volt source 362 and 15-volt source 363. The lead 361 connects, through a 2200-ohm resistor 338, to a juncture 366 which, in turn, connects through a 47000-ohm resistor 350 to the pin numbered "2" of an NS* LM356 op-amp chip 358. An 0.0047 μf capacitor 346 connects between the juncture 366 and a ground 367. The juncture 366 is also connected through a 47000-ohm resistor 342, by means of a lead 369, to the pin numbered "6" of the chip 358. A 0.1 μf capacitor 354 connects between the lead 369 and the pin numbered "2" of the chip 358. The pin numbered "3" of the chip 358 is grounded at 371, and the pins numbered "4" and "7" are connected to −15-volt source 373 and 15-volt source 374, respectively. The pin numbered "2" of a LM356 op-amp 368 is connected through a 10000-ohm resistor 352 to the lead 369, and through a 10000-ohm resistor 364 and a lead 372, to the pin numbered "6" of the same chip. To the pin numbered "3" of the chip 368 a 10000-ohm resistor 360 is grounded at 403 and is connected, through a 10000-ohm resistor 356, to a lead 380, which connects to a trimmer potentiometer 384 having one leg at 15 volts and the other leg grounded. Pins numbered "4" and "7" of the chip 368 connect respectively to a −15-volt source 406 and a 15-volt source 407. The pin numbered "6" of the chip 368 connects, by means of the lead 372, through a 5000-ohm, 1% tolerance resistor 392 to the pin numbered "4" of an ECC205M VCA chip 408. The chip 408 is commercially available from Valley People of Nashville, Tenn.

The lead 369 connects, through a 5000-ohm, 1% tolerance resistor 388, to the pin numbered "4"]of an additional EGC205M VCA chip 404. The lead 394 is branched at 355 so that it passes through a 1300-ohm, 1% tolerance resistor 398 to the pin numbered "1" of the VCA chip 404; and, through another such 13000-ohm resistor 400, to the pin numbered "1" of the chip 408. From the pin numbered "6" of the chip 404 the lead 412 was shown in FIG. 3A to connect to the resistor 424, and, from the pin numbered "6" of the chip 408, the lead 416 was shown to connect to the resistor 428. Pins numbered "2" of the chips 404 and 408 connect to respective 15-volt sources 385 and 365, while pins numbered "3" of the chips 404 and 408 connect respectively to −15-volt sources 405 and 409. The pins numbered "5" of the chips 404 and 408 are connected to respective grounds 340 and 345.

Referring now to FIG. 4, the panpots 151, 152, 156 and 157 hereinabove mentioned are each connected through the respective leads 149, 152, 154, and 155 to the chip 145 (FIG. 1A) as has been described. The leads 155, 154, 152, and 149 are each connected to group through respective 0.1 f capacitors 457, 458, 459, 460, and to respective potentiometers 449, 450, 451, and 452, each of which is connected between a 15-volt source and ground.

My apparatus, hereinabove described, can be looked upon as an automatic panpot. The rest of the described hardware, and the software which has been burned into the chip 12 and which is defined by a computer printout submitted herewith and incorporated herein by reference, is essentially dedicated to providing control voltage to the VCA's. It is recognized that other software may be devised within the scope of my invention to achieve the effects of my novel conception.

The apparatus herein described provides automatic panning control to four tracks, and is expandable to eight tracks with minimal change. Each channel has one input, such as that provided at 355, of audio signal through the lead 394, and two outputs, such as those in the leads 412 and 416. The manual switch 87 (FIG. 1B) provides for three modes of operation: program, automatic and manual. When the switch 87 is in program mode the user can select one of four parameters by first pressing the reset button 305 on the pad 170, and then pressing the push-button 197, followed by one of the push-button 179, 182, 184, or 187 to select a channel from 1 to 4. Then, according to which parameter is being considered, the user will push the push-button 198 for "rate" which determines the length of time, in seconds, for ½ cycle of panning, the push-button 201 for "start" and 202 for "stop" which two parameters determine the loudness range of the pan, and the key 203 for "cycle" which determines how many cycles of panning will take place. This selection of parameters is followed, in each case, by pressing two of the number push-buttons. When the push-buttons of the pad 170 are depressed, the ones selected are displayed in the 7-segment light display 247. This is of great advantage to the busy operator who is thus not burdened to remember what the last step was. Each of the parameters has a specific range of valid values that may be entered. These are CH (channel): 1 to 4, RA (rate): 0 to 99, ST (start): 0–15, SP (stop): 0–15, and CY (cycles): 0–99.

The main element in the software routine, consisting only in software, is a FIFO memory, located in the RAM's of the chips 34, 47, which RAM's are volatile memories for storing program data. The chips 34, 47 also comprise I/O's (input-output units) that perform mostly as output units to relay the data from the CPU 12 to the DAC's 92, 94, 98, and 102, and timers for pulse necessary for synchronous operation of the system. When the CPU 12 receives an instruction from the keyboard it determines its validity and stores it in a FIFO of the chips 34, 47. The process is started after the CH key 97 is pressed followed by a number push-button 179, 182, 184, or 187, causing a number 1–4 to be stored in a software FIFO. The routine looks at the last two instructions in FIFO prior to the last three instructions entered. The instruction is stored on FIFO, echoed in correct format to the display 247 and the FIFO status is modified. After a determination and storage sequence is completed the routine enters a phase that takes related instructions and stores them in correct format in the storage RAM of the chip 47 for use by the Auto routine. This storage RAM is formulated in four blocks of four bytes each, each byte corresponding to one of the channels and also to one of the functions: "rate", "start", "stop", and "cycle", so that the RAM may be thought of as a 4×4 matrix that can easily be expanded to a 4×n matrix with additional channels.

After the user has programmed each of the parameters for each channel he may run the program by switching the switch 87 to Auto mode, which will cause my apparatus to pan automatically without further attention from the operator. It is an important novel feature of my apparatus that during its operation the apparatus origen of the sound between the left and right extremes is displayed, for each channel, by the LED array 271–286 (and three other LED arrays, not shown, of which the array 271–286 is representative). In Auto mode the panning will continue indefinitely if "99" has been selected for the "cycle " parameter (key 203) or it will stop when a lesser number of selected cycles has run its course. Pressing of the reset button 305 will, in Auto mode, restart the selected program from its beginning, and this is another important advantage of my invention, since it frees the user from a more complicated manual operation to control panning. Another advantage of my invention resides in the greater precision and complexity of panning routines that are possible here, and cannot be achieved by manual panning. The reset push-button may, in a known manner, and within the scope of my invention, be arranged for foot operation, or other manner of control by the physical act of an operator.

In manual mode, panning is done through hand manipulation of the pan-pots 151, 153, 156, 157, but the visual display of each channel's panning position still will appear on the array 271–286. Having this display is of great advantage to the sound engineer (or other user) since it enables him to make constant, instantaneous evaluation of the actual sound, with the progress of a panning routine. And, since he is not in the same location as his audiance, he can do panning an he can relate audiance reaction to various panning routines as they appear on the display.

The software that has been burned into the chip 12, and is fully defined in the computer printout submitted herewith has been concieved to enable expansion of my operating system to add features, optimize performance, and facilitate system analysis. Particularly, the system can be expanded to eight tracks, and, with minimal addition of software, will be capable of faster rates and up to 64 panning positions between left and right. One small routine of my software program samples the mode select switch 87 and directs the CPU 12 to the selected mode. Another routine analyses entries to the keypad, processes and displays them, and stores them in memory in the chip 34 for later execution. The routine that, in Auto mode, takes the data stored in program mode and sends information to control the VCA's also supervises the LED position monitor and controls visual monitoring by the LED display 271–286 and its three counterparts.

Figure 2B:
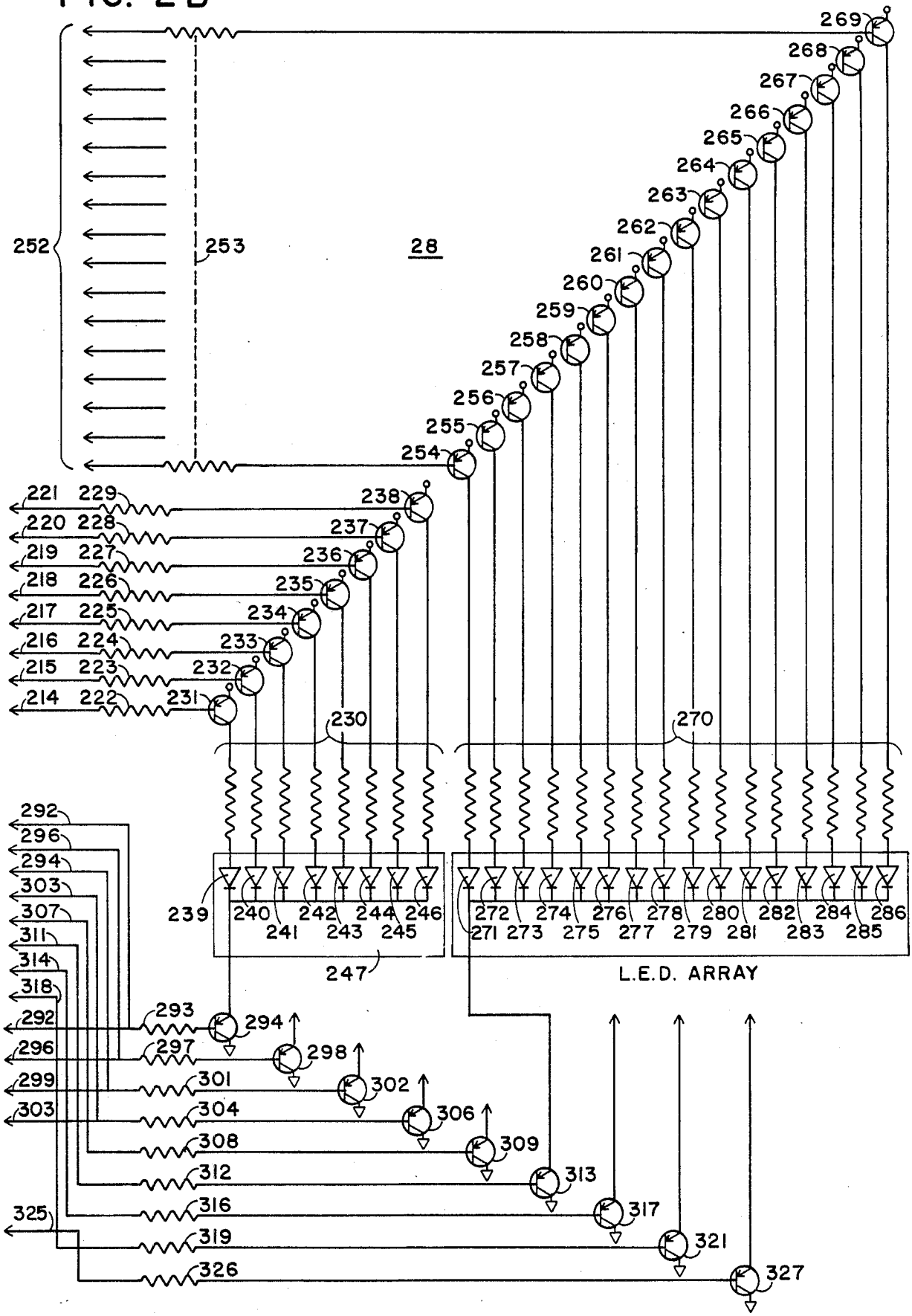

The processing board 11, (FIGS. 1A, 1B) comprises the CPU 12, the 2K ROM 14, the two 0.25K RAM's 34, 47, and the input multiplexed ADC chip 145, and the four DAC chips 92, 94, 98, and 102. The keyboard/display board 28 (FIGS. 2A, 2B) is centered around the chip 38 which communicates with the chip 12 and controls the keyboard 170, display 247, and array 271–286. The VCA/interface board 300 (FIGS. 3A, 3B) is all analog. The VCA's exemplified by the chips 404 and 408 comprise the heart of this board and receive their control voltages from the DAC ships 92, 94, 98 and 102 (FIG. 1B) The board 300 receives the audio signals and does all audio signal processing. It handles audio signal outputs and houses the manual mode pan-pots 151, 153, 156 and 157. Like the software, the described hardware means will allow expansion, with minimal changes or additions.

The Auto routine uses the instructions in the storage ROM to drive the panning sequence, the instructions are transferred from block format to stack format, determining the start and stop positions, and which is relatively greater for a given channel, and also sets the routine for finite or infinite cycles. It outputs a certain channel status word which contains information on start/stop relation, cycle status, and, for later use, a channel status flag, to wit: sequence continues or sequence completed.

Momentary position and routine flow is determined by status of a counters-position-counter, rate counter, cycle counter, start/stop counter and main counter which determines the channel being processed. Each time a new position is calculated an interrupt routine is called which, in turn, calls a send position subroutine that sends the positions to DAC's and display. After transfer to stack format, the routines initiate a main counter that decrements for each channel. For a given channel to routine looks at the rate counter, and if it is zero the position counter is incremented or decremented according to the channel status word. After position counter modification the rate counter is set back to its rate value. If, for example, initially rate counter equals 3 for channel 2, then the routine will not change channel 2 position counter for 3 routine cycles, but will decrement the channel 2 rate counter for each routine cycle. Means for accomplishing these steps and, of course, many more, necessary in practicing the use of my invention, are disclosed in detail in the aforementioned computer printout, incorporated herein by reference.

The manual program basically comprises simply a straight wire program that inputs data from the ADC 145 pertaining to a pan-pot position and outputs the data via a subroutine that is common to the Auto routine. The software interfaces the multiplexed ADC 145 to the chip 12 and is synchronized by a software programmable clock to give the proper sampling and conversion times. My program provides a maximum panning speed, in this embodiment, of one second per cycle (left-right-left). This means that for a rate of zero to one positive segment per routine cycle, 16 positions per half cycle, 32 per cycle, and four channels, a frequency of 128 Hz is needed. This requires that the multiplier for the timers 34 or 47 is $3.172M/128=24000$. This multiplier is divided to 2 and 12000 and sent to the two timers 34, 47. In manual mode the two timers 34, 47 give two separate clocks, one serving as the conversion clock for the ADC 145 and the other as the interrupting clock for the CPU chip 12.

The 3-position mode-selector switch 87 selects a 6-bit word for the 6-bit I/O port of the chip 34, each word corresponding to one of the three operating system routines. Upon reset, the CPU chip 12 starts at address zero. The first few instructions load the word from the I/O port to the CPU 12 and branch it to thr routine corresponding to the selected word.

My key/display board 28 is characterized by having the same hardware drive the 7-segment display and the $4\times16$ position LED arrays, requiring the novel presence of the chip 38 which provides scan lines for the keys and displays, return lines for data from keys and data lines to displays. The first three scan lines are used for the 7-segment display 247 and key pad 170 scanning, and the fourth scan line is used for the position display 271–286. As there are eight data lines, and the position array needs 16, nibble (½ byte–4 bits) provides encoded data to the decoder 249 which decodes the data to 16 bits that drive the position displays. Thus each display operates independently. On the VCA board 300 the output current from the DAC's 92, 94, 98, 102 is converted to an output voltage by the op-amps 112, 113, 114, and 115 in non-inverting configuration. The output DAC voltage is $V_{DAC}$=DATA(8-bit in)/256. $V_{DAC}$ is essentially a sample-hold voltage which is filtered by a rolloff to provide a smooth voltage wave form. The filtered output is inverted and connects directly to the VCA's. Although I do not wish to be limited thereto, I prefer to use ECC 205M VCA's supplied from Valley People (elsewhere identified) since they provide all the necesary biassing and trimming hardware. These VCA's act as the variable gain blocks for the left-right cross fading or panning. Accurate panning is a constant power function where $V_L^2+V_R^2=V_{in}^2$. I estimate this function by using 2 VCA's for each channel, one for left fade and the other for right fade, which follows the constant power equation quite accurately. In the following discussion $V_c$ is the DAC output filtered and converted to a voltage signal. VCA's are designed with a transfer function:

$$V_{out}=V_{in}*10\exp(-V_c),\ V_r=V_{in}*(1-10\exp(-V_c))$$

Therefore: $V_1=V_{in}*(1-10\exp(-(V_{cmax}-V_c)))$

The resulting power equation: $P=V_r^2+V_l^2$; $P_{in}=1.0000$, gives a $P_{max}=0.9351$ and $P_{min}=0.9000$. Multiplying by gain factor $A=1/0.9$ for unity gain gives a delta $P=0.1667\ dB$, a small enough deviation for any application.

The foregoing description has been exemplary rather than definitive of my invention for which I desire an award of Letters Patent as defined in the appended claims.

I claim:

1. An apparatus for projecting a sequence of sounds comprising:

(A) means for energizing each of a plurality of at least four mutually independent pairs of voltage-controlled amplifier means actuating loudspeaker means, (B) means for automatically, alternately, and repeatedly reducing the relative energy to one member while increasing the relative energy to the other member of each of said pairs, (C) a plurality of user-operated manual switch means each of which represents, in a first mode, a specific number of cycles of said energy reducing and increasing means for presetting said number of cycles for each of said pairs, (D) said plurality of user-operated manual switch means representing in a second mode the minimum and maximum energy of each of said cycles for presetting said minimum and maximum energy for each of said pairs, (E) said plurality of user-operated manual switch means representing in a third mode the frequency of said cycles for presetting said frequency for each of said pairs, (F) user-operated manual switch means for automatically continuingly repeating said number of cycles, and (G) user-operated manual switch means for simply restarting said reset number of cycles.

2. The apparatus of claim 1 comprising a single panel visual display means continuously displaying the apparent location of the source of sound energy to each of said pairs.

3. The apparatus of claim 1 comprising a microcomputer central processing unit, said energizing means and said reducing and increasing means being under control of said unit.

4. The apparatus of claim 3 comprising a microcomputer central processing unit, said energizing means, said reducing and increasing means, and said display means being under control of said unit.

* * * * *